US007168373B1

(12) United States Patent
Hock

(10) Patent No.: US 7,168,373 B1
(45) Date of Patent: Jan. 30, 2007

(54) ELEVATION ADJUSTMENT DEVICE IN THE LEGS OF TABLE

(76) Inventor: Koh Tuang Hock, P.O. Box 697, Fongyuan City, Taichung County 420 (TW)

( * ) Notice: Subject to any disclaimer, the term of this patent is extended or adjusted under 35 U.S.C. 154(b) by 177 days.

(21) Appl. No.: 10/997,851

(22) Filed: Nov. 29, 2004

(51) Int. Cl.
*A47B 9/20* (2006.01)

(52) U.S. Cl. ..... 108/147.21; 108/147.11

(58) Field of Classification Search ..... 108/144.11, 108/146, 147.11, 147.12, 147.19, 147.21, 108/147; 248/188.5, 188.2, 161, 407, 408, 248/411, 414, 423
See application file for complete search history.

(56) References Cited

U.S. PATENT DOCUMENTS 2,293,144 A * 8/1942 Jones ..... 248/408
2,398,693 A * 4/1946 Bureau ..... 108/147.21
2,605,987 A * 8/1952 Brown et al. ..... 248/408
2,748,261 A * 5/1956 Wolar ..... 248/407
2,872,252 A * 2/1959 Konkle ..... 108/147.21
3,855,946 A * 12/1974 Bales ..... 108/147.21
4,113,221 A * 9/1978 Wehner ..... 248/408
5,107,775 A * 4/1992 Langlais et al. ..... 108/147.21
6,209,840 B1 * 4/2001 Chen ..... 248/407
6,354,231 B1 * 3/2002 Morris ..... 108/144.11
6,467,747 B1 * 10/2002 Ellsworth ..... 248/408
6,920,834 B1 * 7/2005 Pehta et al. ..... 108/147.21
6,923,410 B2 * 8/2005 Chang ..... 248/188.5

* cited by examiner

*Primary Examiner*—José V. Chen

(57) ABSTRACT

An elevation adjustment device in the legs of table includes a rectangular leaf and four legs connected to the underside of four corners of the leaf. The legs each has a first tube and second tube slidably inserted into the first tube having graduation on outer periphery, a tubular sleeve engaged with the lower end of the first tube, a tubular stopper with a circular pad pressed into the lower end of the second tube, a pushing rod connected to a threaded shank inserted into a circular through hole of the first tube and a protrudent radial through hole in a segmental retaining bar, an enlarged retaining ring, a washer and a spring sequentially wrapped on the threaded shank and secured by a internally threaded cap from the inner end of the shank.

3 Claims, 12 Drawing Sheets

ELEVATION ADJUSTMENT DEVICE IN THE LEGS OF TABLE

BACKGROUND OF THE INVENTION

The present invention relates to the furnitures and more particularly to an elevation adjustment device in the legs of table which device is embedded in the legs and readily to operate to adjust the height of a table.

The legs of a table not only sustain the leaf of the table but also adjust the height or the balance of the table. So that the vertically adjustable legs is very important for the table. Nowadays, the adjustable legs are no other than utilized an elastic steel ball or a check mechanism to secure the leg after the leg is vertically adjusted. Generally, this check mechanism only uses a steel ball and a U-shaped elastic plate embedded in the leg depending upon the steel ball engaged within a positioning hole in the leg to bear the whole weight of the table that the suspending force is rather weak especially if a dinner set on the table. When disengages the steel ball with the positioning hole to perform a vertical adjustment, the upper tube of the leg must be rapidly slid down such that the finger of the operator is always in a harmful condition.

Further, utilizes this type of check mechanism to adjust the height of the table, one has to slide the upper tube of the leg to an uppermost position at first for releasing the check mechanism then slides down to a lowermost position so as to enable the operator to move the tube upward to seek a desired position to engage the steel ball with a positioning hole to accomplish the height adjustment for the table. This process is usually repeated several times before the adjustment is worked out. If four legs of a table all need to adjust, the operator must exhausts a great deal of time and labor. That's very inconvenient.

SUMMARY OF THE PRESENT INVENTION

The present invention has a main object to provide an elevation adjustment device in the legs of table which device has graduations on the lower tube to enable the operator sliding the tube up or downward to readily select a graduation to fix the length for each of the four legs similarly and rapidly without frying repeatedly.

Another object of the present invention is to provide an elevation adjustment device in the legs of table in which a check mechanism is capable of bearing greater weight of the table and hid away into the legs without affecting the outer beautification of the legs.

Still another object of the present invention is to provide an elevation adjustment device in the legs of table. When the operator push the retaining pin inward to conduct the vertical adjustment of the legs will not be hurt due to the safety arrangement.

Further object of the present invention is to provide an elevation adjustment device in the legs of table which is composed of a first and a second tube capable of reverse assembly in accordance with the requirement of the user.

Accordingly, the elevation adjustment device in the legs of table of the present invention comprises generally a table having four legs each of which has an upper tube secured to the underside of the leaf and an internal tube in the bottom, a segmental retaining bar of predetermined length disposed into the upper tube and connected on the top with a positioning plate in the top of the upper tube having flat sliding space longitudinally formed in the center and a protrudent radial through hole engaged with a circular through hole in a periphery of the upper tube for insertion of a retaining pin which is biased by a spring and having an enlarged diametered retaining ring, a lower tube having a detention plate slidably inserted into the flat sliding space of the segmental retaining bar including a longitudinal sliding slot in the center in which is a plurality of check recesses formed spaced apart and a tubular stopper together with a circular pad secured to the bottom of the lower tube which has a plurality of graduations formed spaced apart on outer periphery. When pushes the retaining pin inward, its enlarged retaining ring disengaged with the check recess of the detention plate so as to enable the retaining pin sliding about to adjust the length for the legs.

The present invention will become more fully understood by reference to the following detailed description thereof when read in conjunction with the attached drawings.

DETAILED DESCRIPTION OF THE PREFERRED EMBODIMENT

Figure 1:
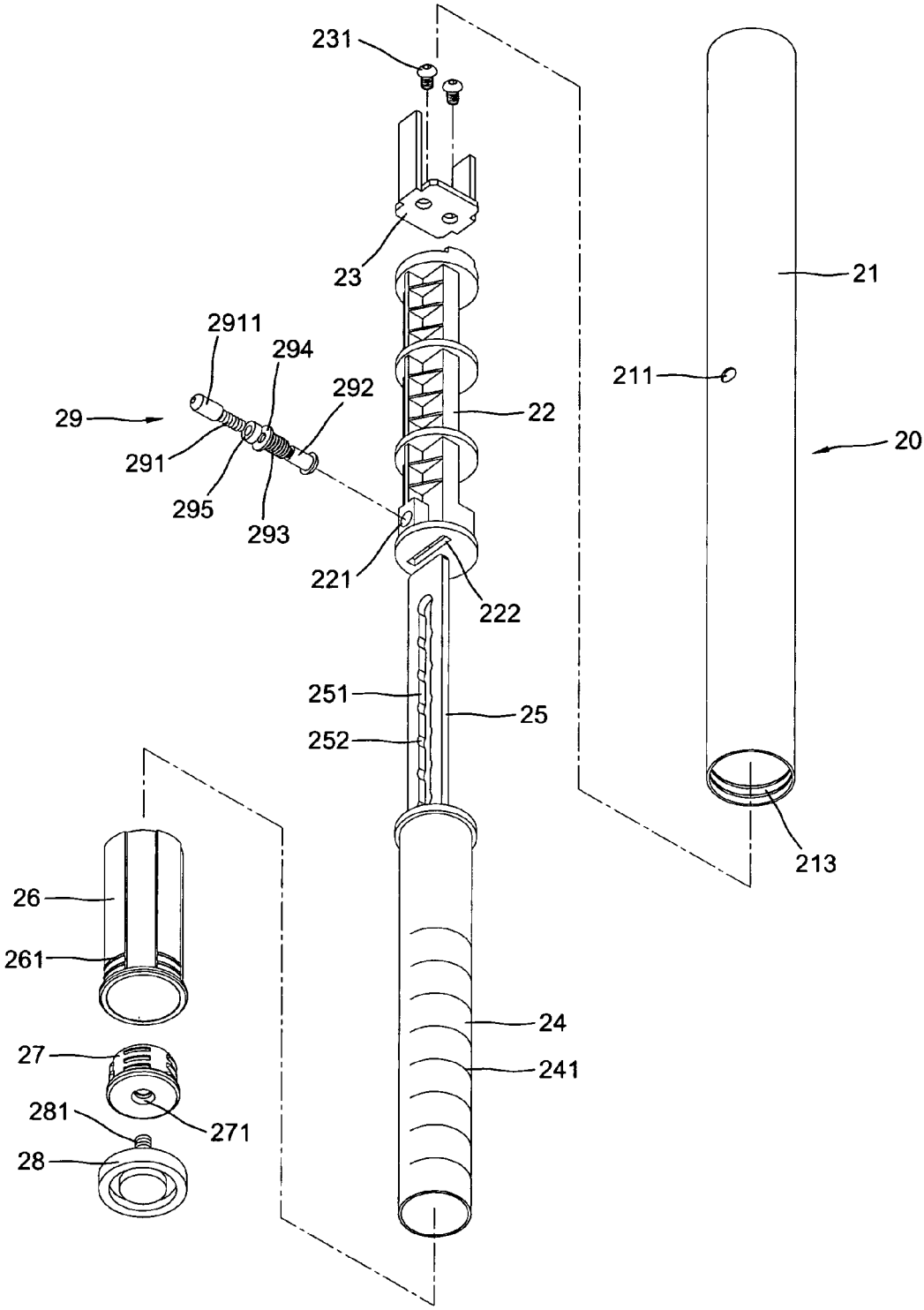
FIG. 1 is an exploded perspective view to show a first preferred embodiment of the elevation adjustment device of the present invention.
Figure 2:
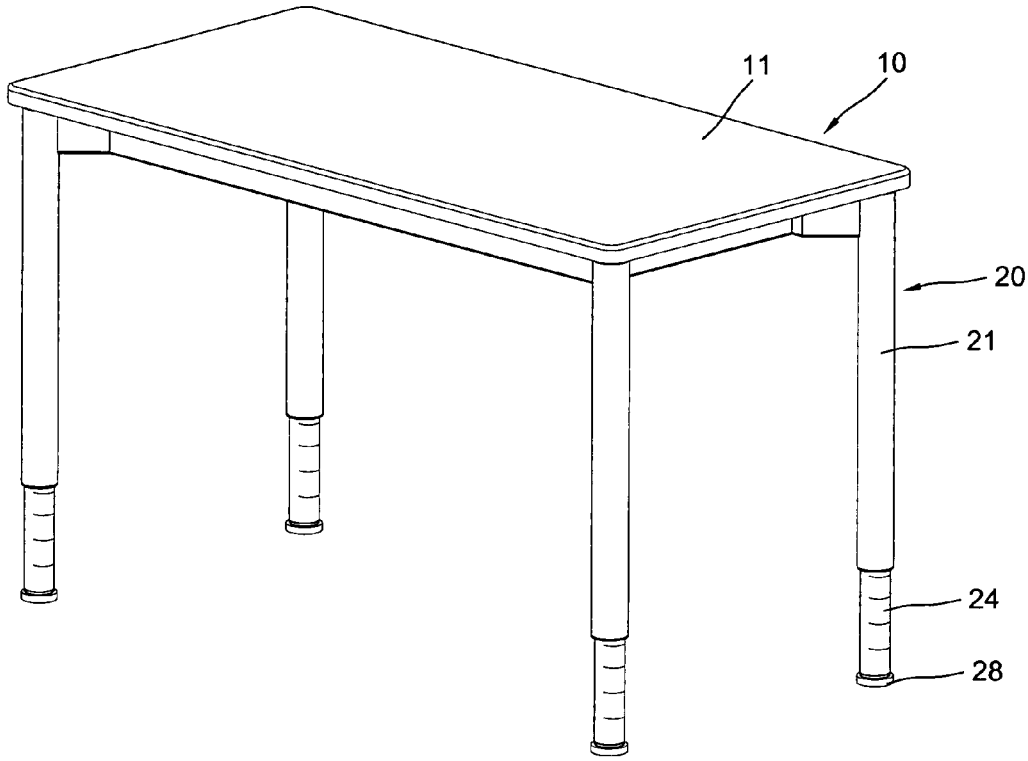
FIG. 2 is a perspective view to show a table having legs of FIG. 1.
Figure 4:
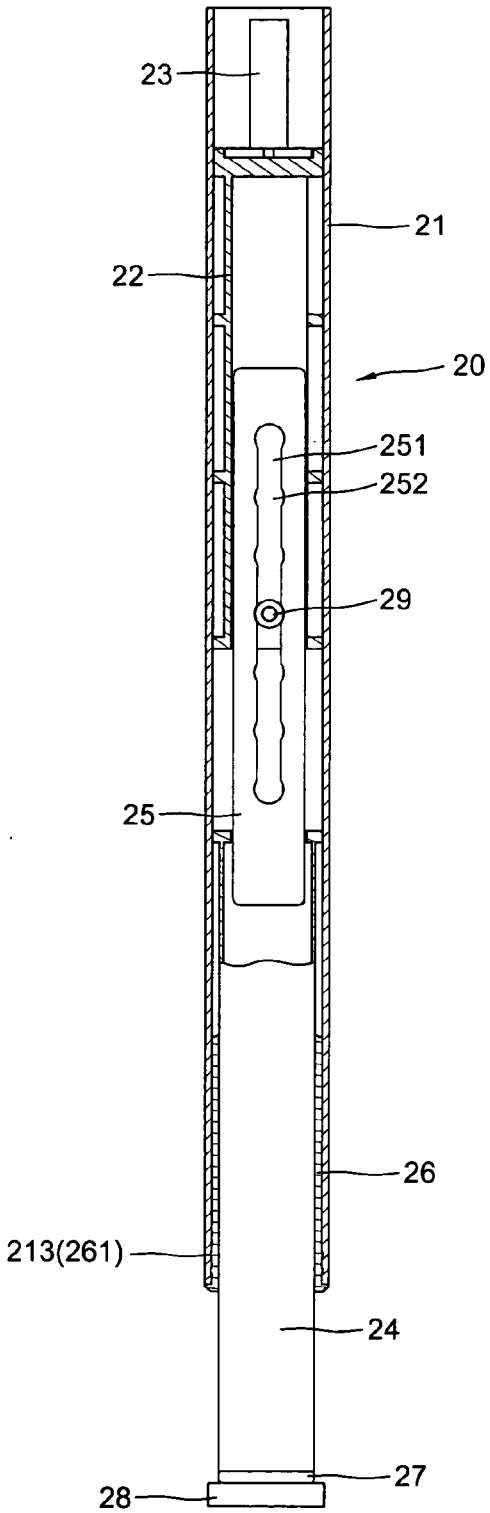
FIG. 4 is a longitudinal sectional view of FIG. 3.
Figure 3:
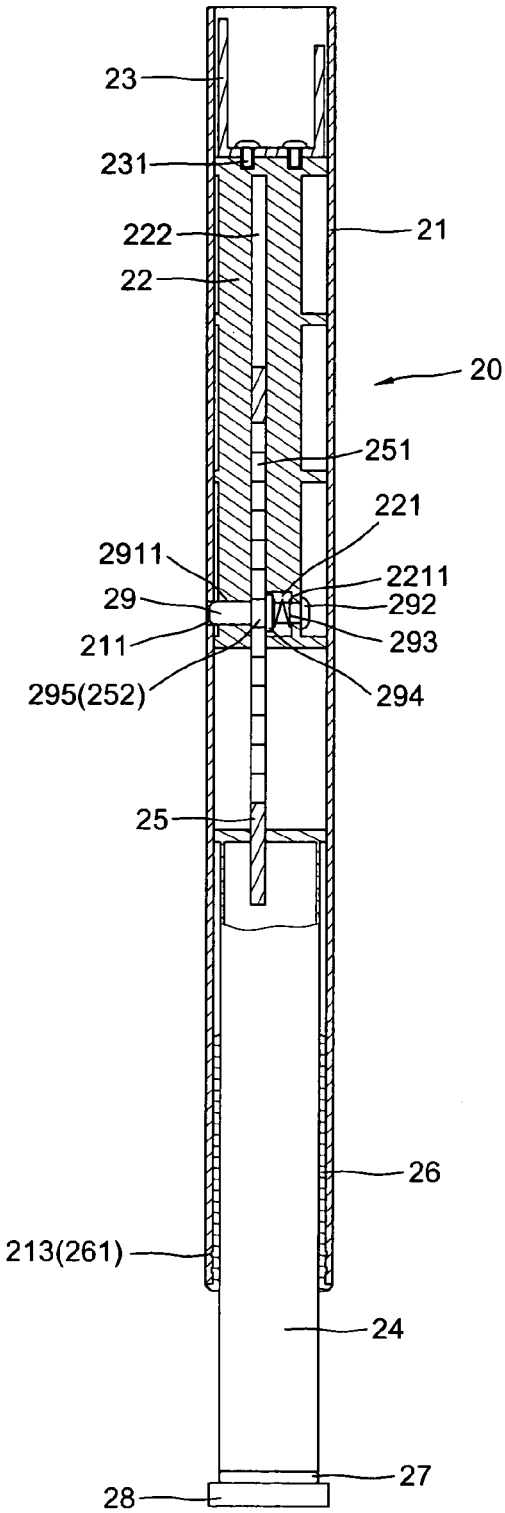
FIG. 3 is a sectional view to show the assembly of FIG. 1.
Figure 5:
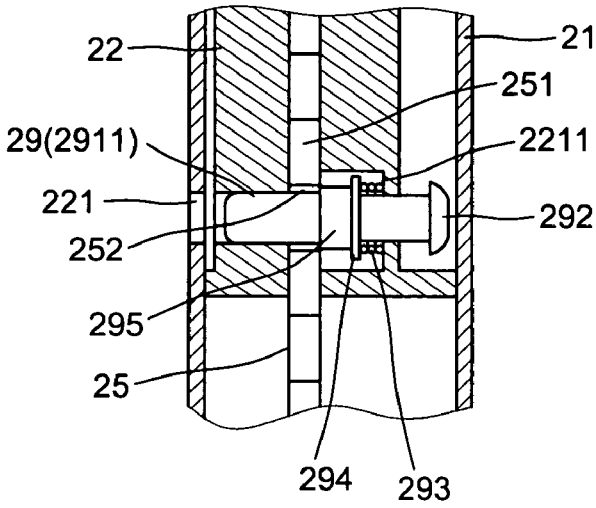
FIG. 5 is a cross sectional view to show that the retaining pin is disengaged with the check recess of the detention plate.
Figure 6:
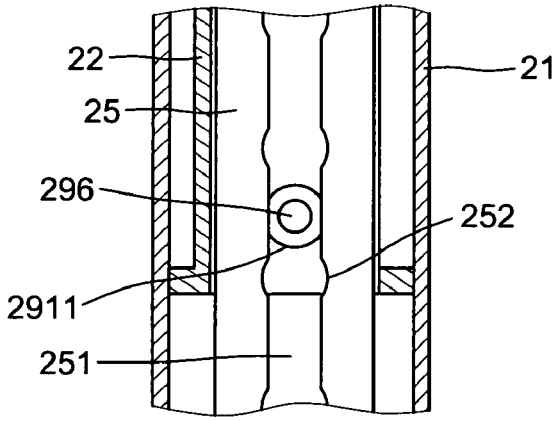
FIG. 6 is a longitudinal sectional view of FIG. 5.
Figure 8:
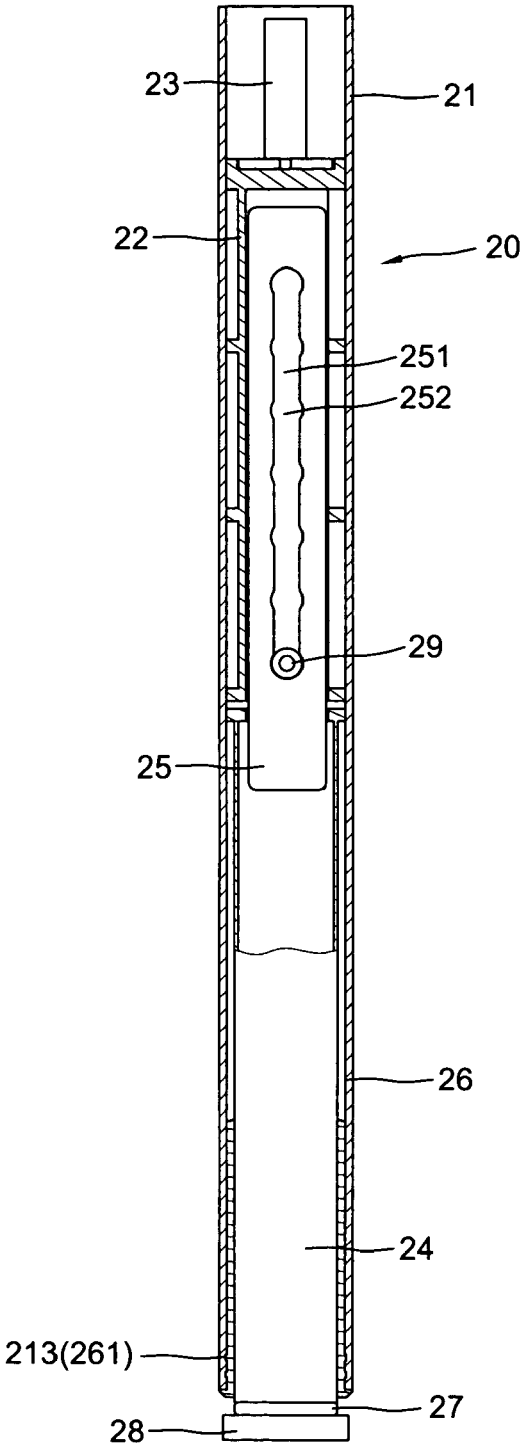
FIG. 8 is a longitudinal sectional view of FIG. 7.
Figure 7:
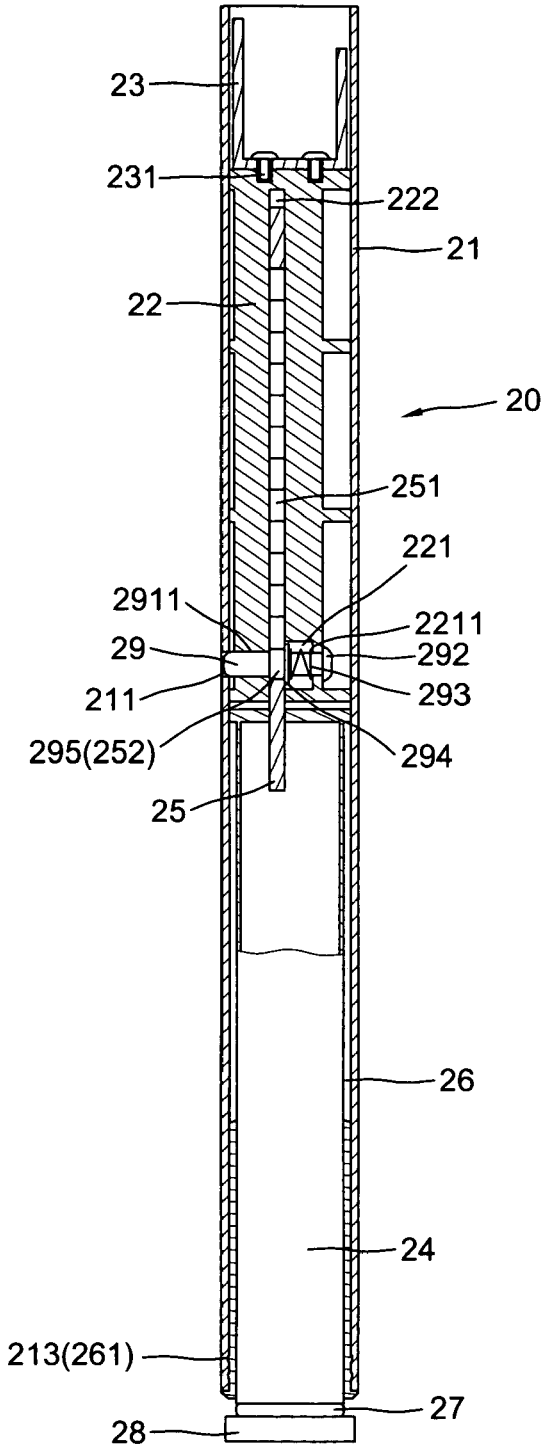
FIG. 7 is a cross sectional view to show that the upper tube of the leg is adjusted downward.

With reference to the drawings and initiated from FIGS. 1 to 4, a first embodiment of an elevation adjustment device in the legs of table of the present invention comprises a table 10 having a rectangular leaf 11 and four identical legs 20 respectively sustaining the four corners of the leaf 11. The legs each has a first tube 21 which includes a circular through hole 211 in a middle periphery and inner threads 213 in the lower end, a segmental retaining bar 22 disposed into the first tube 21 and secured to the underside of a roughly U-shaped positioning plate 23 in the upper end of the first tube 21 and fastened by a pair of screws 231 and having a plurality of eccentric annular flanges formed spaced apart on the body and reinforced by a plurality of triangular ribs therebetween, a protrudent radial through hole 221 abutting lower end engaged with the circular through hole 211 of the first tube 21 and a flat longitudinal sliding space 222 in the body for slidably disposing a flat detention plate 25 which is projected upward from the top of a diametrically reduced second tube 24, wherein the flat detention plate 25 has a longitudinal sliding slot 251 formed in the center including a plurality of check recess 252 formed spaced apart therein and the second tube 24 has a plurality of graduations 241 graved spaced apart in the outer periphery, a tubular sleeve 26 inserted into the lower end of the first tube 21 and sleeved on the outer periphery of the second tube 24 and having threads 261 on lower outer periphery engaged with the inner threads 213 of the first tube 21, a tubular stopper 27 pressed into the lower end of the second tube 24 having a central screw hole 271 in the bottom for engaging with a threaded shank 281 on the top of a circular pad 28 and a check pin 29 inserted into the protrudent radial through hole 221 of the segmental retaining bar 22 via the circular through hole 211 of the first tube 21 and composed of a threaded shank 291 on the inner end of a pushing rod 2911, an enlarged retaining ring 295, a washer 294 and a spring 293 sequentially wrapped on the threaded shank 291 on the inner end of which is engaged with an internally threaded flanged cap 292 from the other side of the protrudent radial through hole 221 (as shown in FIGS. 5 to 8). The pushing rod 2911 may be uniform with the periphery of the first tube 21 or protrudent out that facilitates the operation of the operator. It is supposedly that the pushing rod 2911 is uniform with the periphery of the first tube. The operator has to use a bar of corresponding diameter to push the pushing rod 2911 inward to have the enlarged retaining ring 295 disengaged with the check recess 252 of the flat detention plate 25. Due to that the pushing rod 2911 is diametrically smaller than that of the check recess 252 and is stopped within the check recess 252, the first tube 21 is able to move downward or otherwise the second tube 24 moves upward. While the pushing rod 2911 is slid about the sliding slot 251 until the operator decide a desired height for the legs 20 in accordance with the graduations 241 of the second tube 24. Then releases the pushing rod 2911 which will be automatically returned to its original position by the resilience of the spring 293. So that the horizontal surface of the leaf 11 of the table 10 is adjusted lower.

If one wants to rise up the leaf 11 of the table, do the above process reversely by moving the first tube 21 upward or the second tube 24 downward to elongate the length of the legs 20. The upper surface of the leaf 11 of the table 10 is therefore becoming higher.

The segmental retaining bar 22 and the flat detention plate 25 have the mutual checking and relative displacement function that display stronger retaining force, especially that the flat detention plate 25 is made of metallic material can bear greater weight including the leaf 11 itself and the heavy objects on the leaf 11 without damaging the adjustment structure of the present invention and eliminating the disadvantage of the prior art checking device which only depends upon a steel ball on a U-shaped elastic plate that provides poor bearing force.

Figure 9:
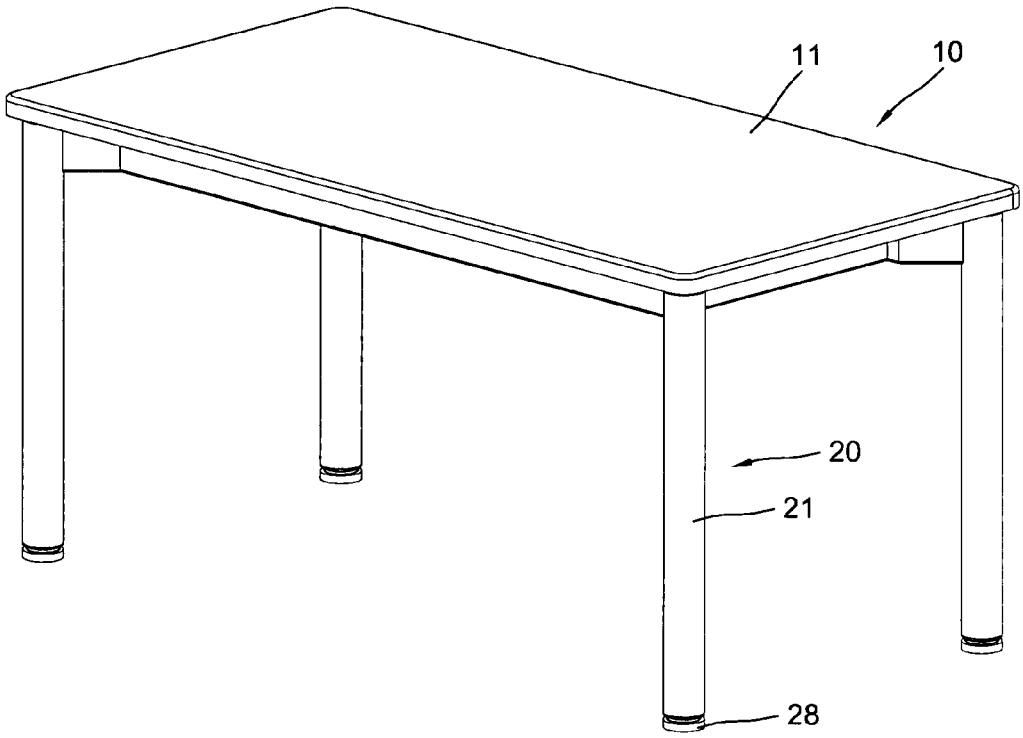
FIG. 9 is a perspective view to show that the legs of the table are lengthily adjusted.
Figure 10:
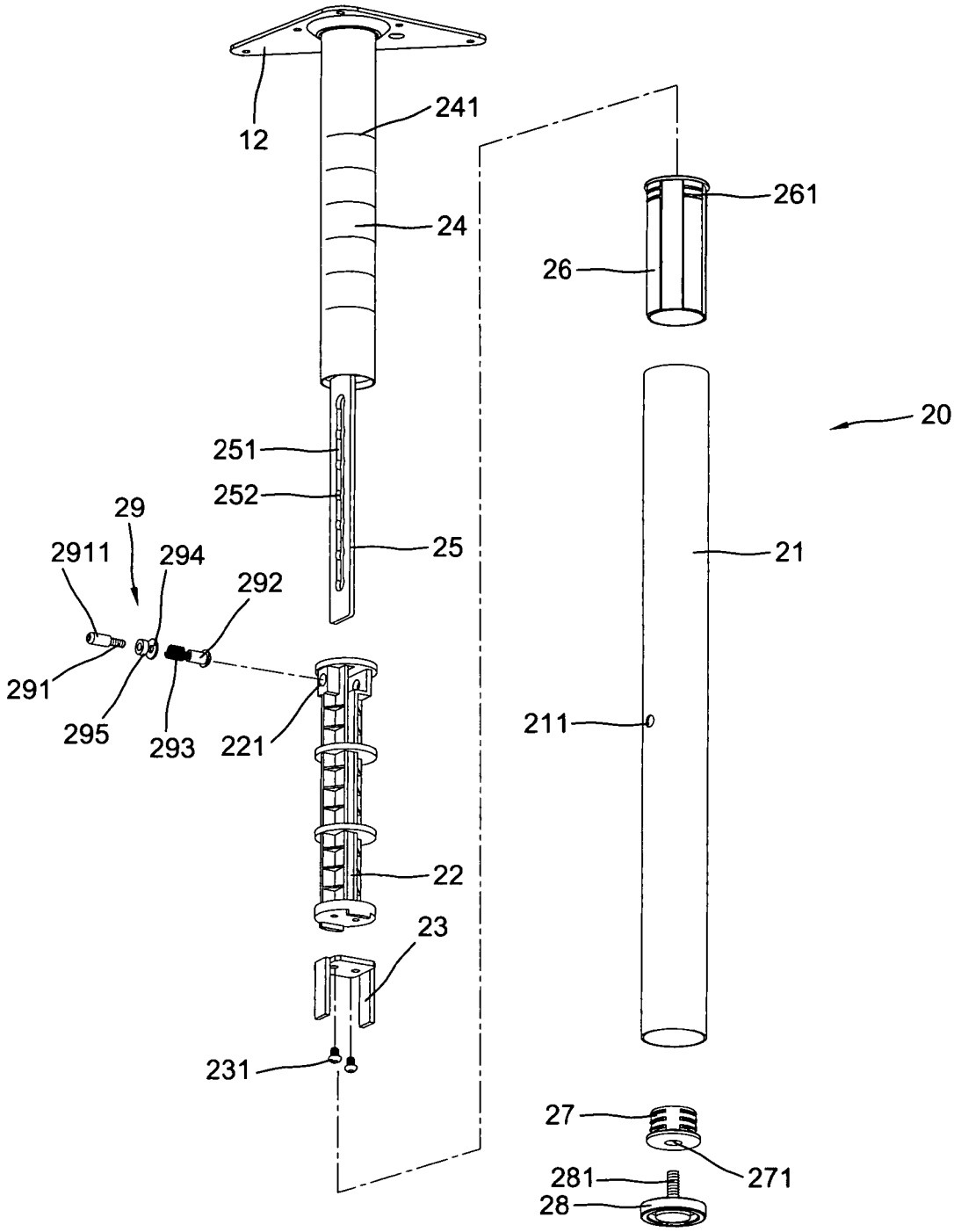
FIG. 10 is an exploded perspective view to show a second embodiment of the elevation adjustment device of the present invention.
Figure 11:
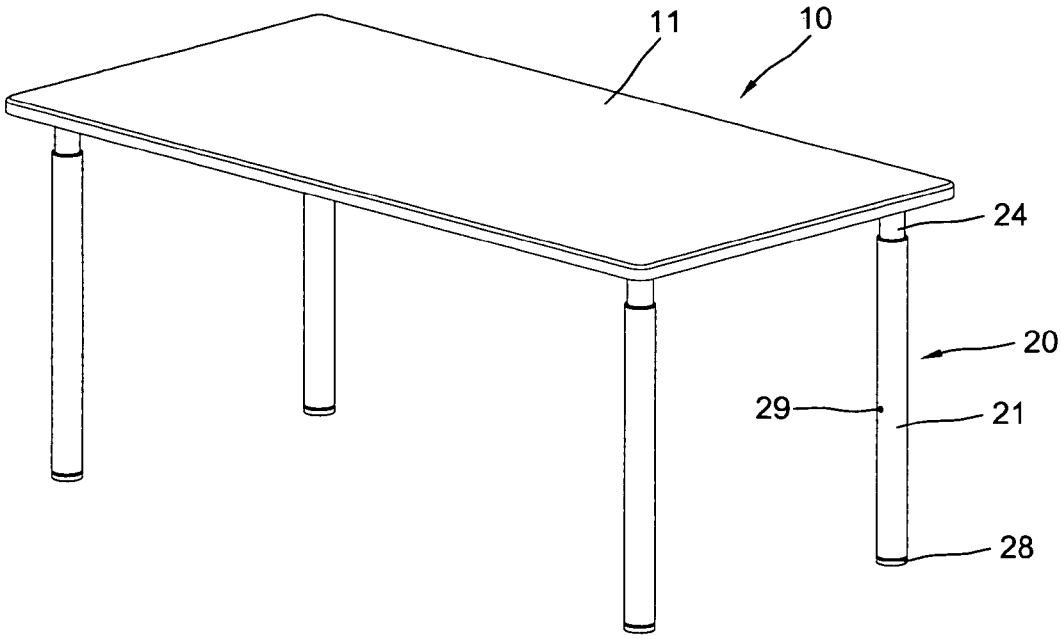
FIG. 11 is a perspective view to show the legs of a table belong to the second embodiment.
Figure 13:
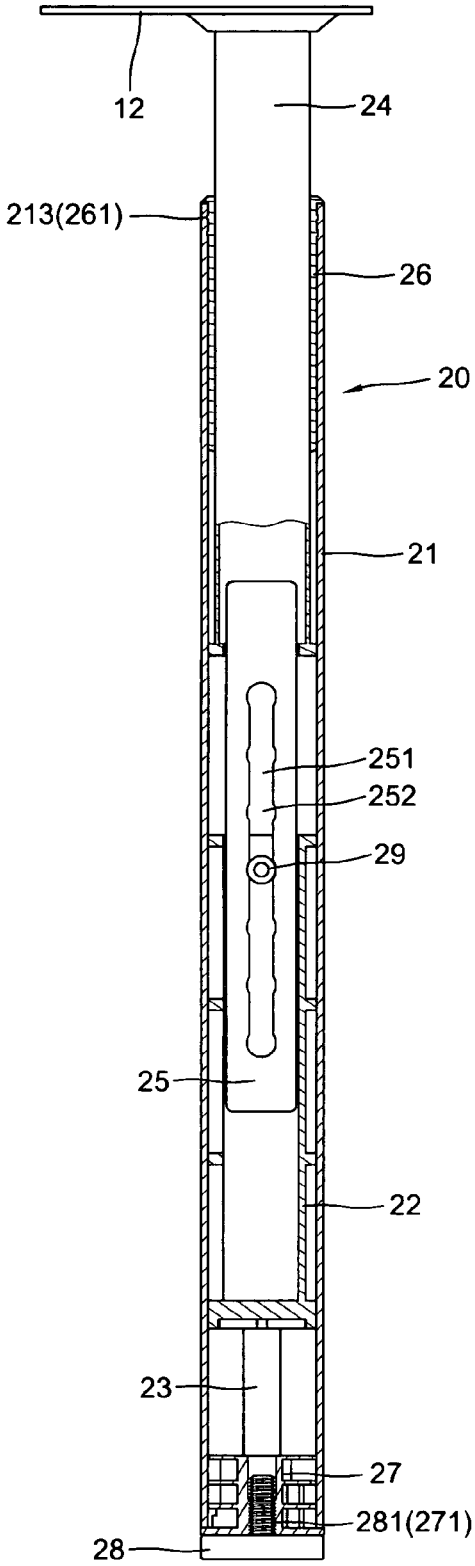
FIG. 13 is a longitudinal sectional view of FIG. 12.
Figure 12:
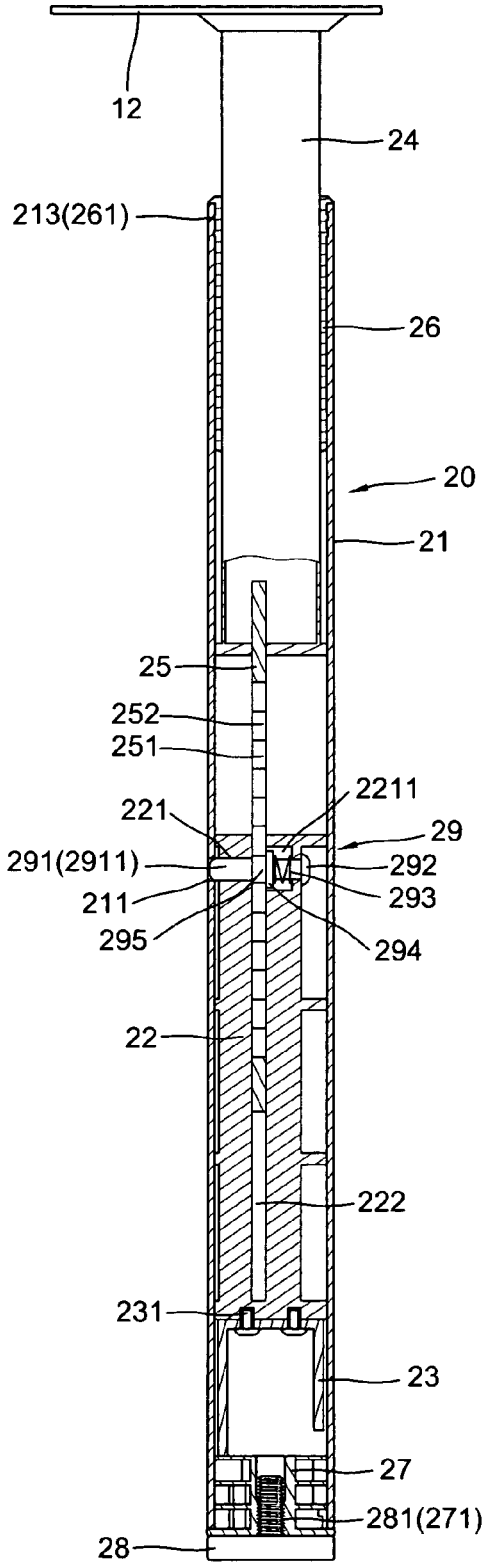
FIG. 12 is a cross section to show the assembly of the second embodiment.
Figure 14:
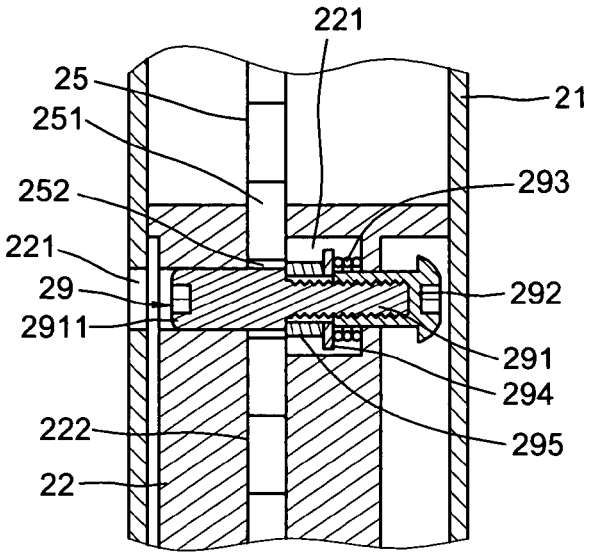
FIG. 14 is a cross section to show the disengagement of the retaining pin with the check recess of the detention plate.
Figure 15:
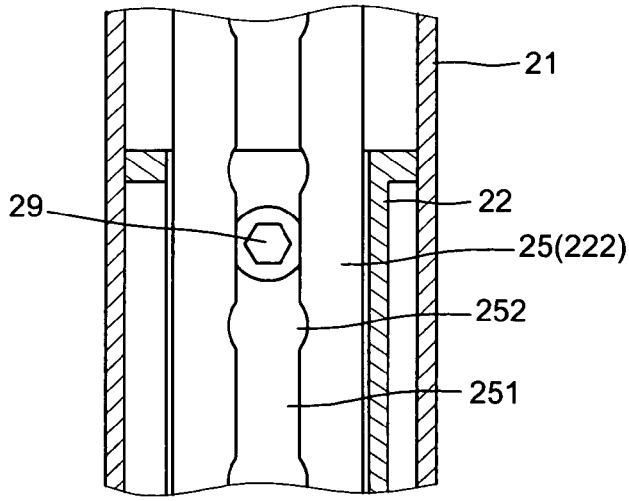
FIG. 15 is a longitudinal sectional view of FIG. 14.
Figure 17:
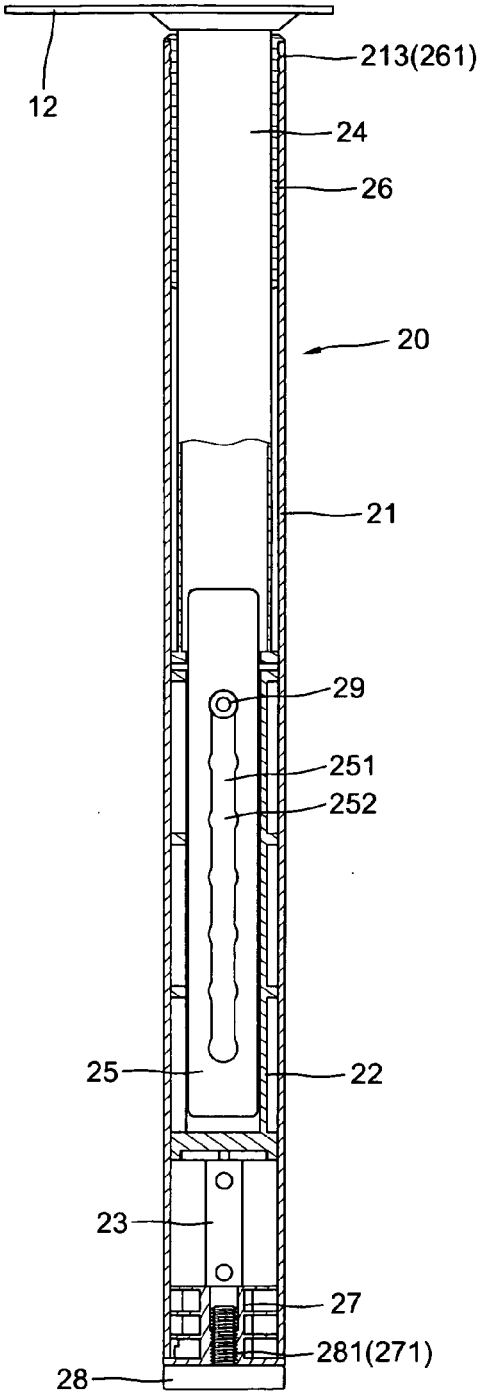
FIG. 17 is a longitudinal sectional view of FIG. 16.
Figure 16:
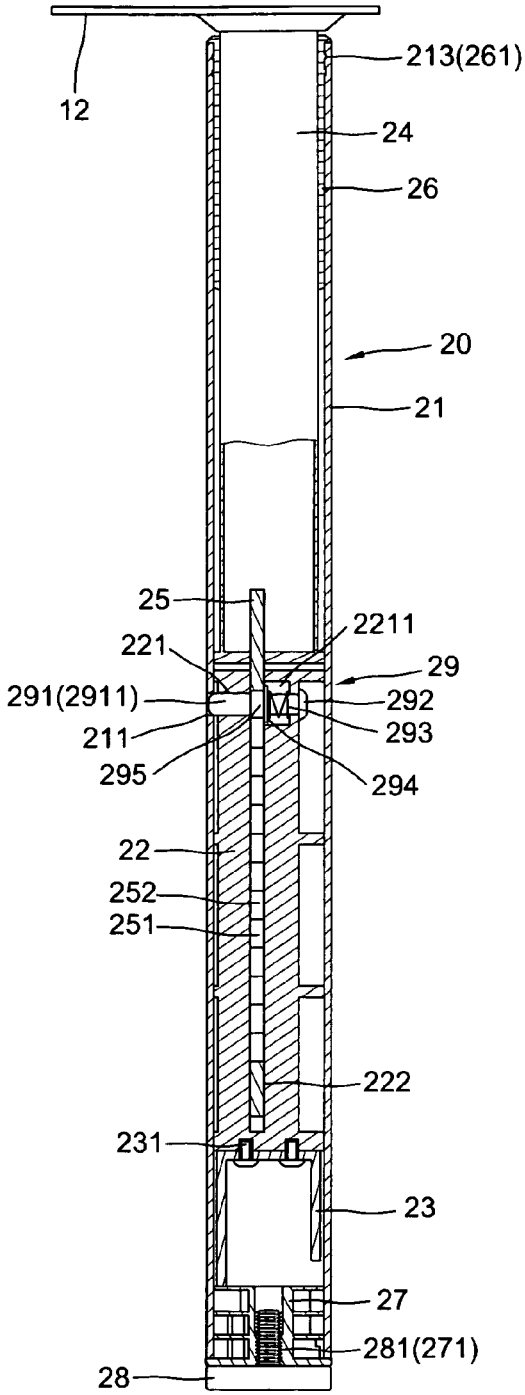
FIG. 16 is a cross section to show that the upper tube of the leg is adjusted downward.
Figure 18:
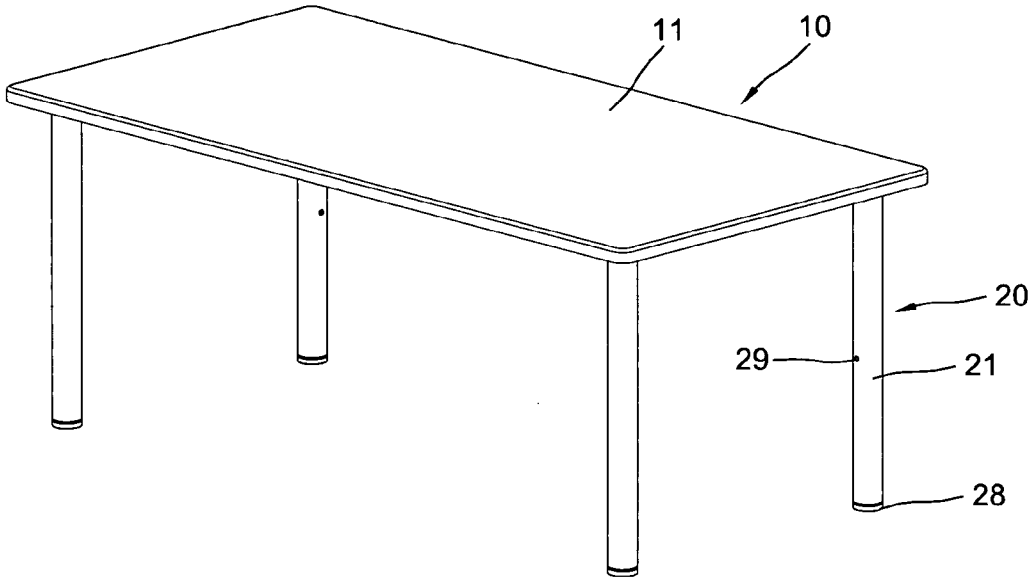
FIG. 18 is a perspective view to show the legs of the table are lengthily adjusted.

Except the strong structure of the adjustment device, the present invention also provides a rapid and precise adjustment process. The graduations 241 on the second tube 24 are as a reference to the operator to speed up the adjustment activities. Further, both the check pin 29, the segmental retaining bar 22 and the flat detention plate 25 are all embedded into the first tube 21, even if a small part of the pushing rod 2911 protrudes the leg 20 do not affect the neat and uniform outer look of the present invention but insures a safety operation (as shown in FIG. 9).

Referring to FIGS. 10 to 13, a second embodiment of the elevation adjustment device of the present invention is provided. This embodiment is structurally and functionally most similar to the first embodiment as described in FIGS. 1 to 9 and the afore-discussions are applicable in the most instances. The only difference is that the four legs 20 are reversely connected to the underside of the leaf 11 with a triangular plate 12 engaged therebetween. The upper end of the first tube 21 is toward downward and receives the stopper 27 and the circular pad 28 which still stands on the ground. Other elements belong to the elevation adjustment device remaining unchanged but they are disposed upside down. The operation process (as shown in FIGS. 14 to 18) is also unchanged as referring to the first embodiment.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

The invention claimed is:

1. An elevation adjustment device in the legs of table comprising:

a table having a rectangular leaf including a top and an underside respectively sustained under four corners by four identical legs each of which has a first tube having an upper end connected to the underside of said leaf, inner threads in lower end and a circular through hole in a middle periphery, a segmental retaining bar disposed into said first tube and secured to an underside of a U-shaped positioning plate in upper portion of said first tube by a pair of screws and having a plurality of eccentric annular flanges spacedly formed on the body with a plurality of triangular ribs disposed therebetween, a protrudent radial through hole abutting lower end engaged with the circular through hole of said first tube and a flat longitudinal sliding space in the body for slidably disposing a flat detention plate which is projected upward from a top of a second tube having a longitudinal sliding slot in center with a plurality of check recess spacedly formed therein, wherein said second tube disposes into said first tube together with said flat detention plate having graduations formed spaced apart on outer periphery, a tubular sleeve inserted into lower end of said first tube positioned between said first and second tubes having outer threads on lower end engaged with the inner threads of said first tube, a tubular stopper pressed into lower end of said second tube having a central screw hole in a bottom for engaging with a threaded shank of a circular pad which stands on the ground, and a check pin having a pushing rod with a threaded shank inserted into the protrudent radial through hole of said segmental retaining bar via the circular through hole of said first tube, an enlarged retaining ring, a washer and a spring sequentially sleeved on said shank and an internally threaded flanged cap secured to inner end of said shank from other side of said protrudent radial through hole, wherein said enlarged retaining ring is operated by said pushing rod in cooperated with said spring to engage and disengage within said check recess of said flat detention plate for controlling the sliding movement of said flat detention plate to adjust the length of said legs.

2. The elevation adjustment device as recited in claim 1, wherein said legs may turn upside down by connecting the lower end of said second tube to the underside of said leaf and move said tubular sleeve together with said tubular stopper said circular pad from the lower end of said first tube to the upper end thereof.

3. The elevation adjustment device as recited in claim 1, wherein said flat detention plate is made of metallic material.

* * * * *